US007774893B2

(12) United States Patent
Keane

(10) Patent No.: US 7,774,893 B2
(45) Date of Patent: Aug. 17, 2010

(54) PAINTING ACCESSORY

(75) Inventor: Carolyn Keane, Lake Worth, FL (US)

(73) Assignee: Keane Corporation, Lake Worth, FL (US)

( * ) Notice: Subject to any disclaimer, the term of this patent is extended or adjusted under 35 U.S.C. 154(b) by 662 days.

(21) Appl. No.: 11/057,483

(22) Filed: Feb. 14, 2005

(65) Prior Publication Data

US 2005/0217059 A1 Oct. 6, 2005

Related U.S. Application Data

(60) Provisional application No. 60/559,848, filed on Apr. 6, 2004.

(51) Int. Cl.
*B44D 3/12* (2006.01)
*B65D 25/20* (2006.01)

(52) U.S. Cl. ..... 15/257.06; 15/257.05; 220/570

(58) Field of Classification Search ..... 15/256.05, 15/256.06; 220/570

See application file for complete search history.

(56) References Cited

U.S. PATENT DOCUMENTS

| | | | | |
|---|---|---|---|---|
| 2,661,858 | A * | 12/1953 | Howell | 15/257.06 |
| 4,860,891 | A | 8/1989 | Biggio | |
| 4,890,353 | A * | 1/1990 | Shannon et al. | 15/257.01 |
| 5,079,795 | A | 1/1992 | Schmid | |
| 5,493,751 | A * | 2/1996 | Misiukowiec et al. | 15/257.06 |
| 6,419,106 | B1 | 7/2002 | Bebak | |
| 6,622,340 | B2 | 9/2003 | Rosa | |

* cited by examiner

*Primary Examiner*—Laura C Guidotti
(74) *Attorney, Agent, or Firm*—Novak Druce+Quigg; J. Rodman Steele, Jr.; Gregory M. Lefkowitz

(57) ABSTRACT

A painting device directed to an open-ended tray that can receive a brush or roller in either one of two possible orientations. The tray may be maintained in either a generally vertical alignment or a generally horizontal alignment. Also holding means extend from the tray whereby a paint applicator can be temporarily attached to the paint tray when not in use.

18 Claims, 3 Drawing Sheets

PAINTING ACCESSORY

CROSS REFERENCE TO RELATED APPLICATION

The application claims priority to U.S. Provisional Patent Application Ser. No. 60/559,848 filed on Apr. 6, 2004 with the title PAINTING ACCESSORY, the entirety of which is herein incorporated by reference.

FIELD OF THE INVENTION

The present application relates to paint trays.

BACKGROUND OF THE INVENTION

The combination of paint tray and roller has been available for many years. Until relatively recently, the trays have been open four-sided receptacles usually of metallic material which could be attached to ladder rungs by hook-like extensions and which were typically horizontally oriented.

Recently, a modified design has been developed to enable the tray to assume a variety of different positions. The flat tray-like device has a receptacle area of generally L-shaped configuration. The tray may have a handle at the opposite end from the L-shaped receptacle area so that the device may be set upright with its longest dimension that would be formally perceived as the bottom, in fact, a side with ripples to allow paint to be rolled off the roller portion to avoid a drip path. This modified style paint tray device can be oriented horizontally so that the ripple portion is horizontal, as previous trays were typically oriented.

This style tray can be easily carried as the L-shaped portion has a side and two ends with enough depth to accommodate considerable paint yet to enable the device to be carried by its handle. This type of design greatly increases the portability of a paint tray making it easily carried about a job with its orientation at a variety of positions through a range of approximately 90 degrees.

While this improved type of tray has advantages over the earlier design where such tray could be used essentially only in one orientation, i.e. with the ripple structure horizontal, there are still a variety of shortcomings of such device.

One shortcoming is the inability to firmly secure a paint roller to the paint tray when such a roller is not in use.

As typically painting jobs require the intermittent but regular use of brushes in addition to a roller, it is also a disadvantage not to be able to accommodate paint brushes when not in use particularly if the paint tray is to be used on ladders and other somewhat inaccessible locations. In other words, it becomes a desire to have a holding place for brushes when a roller is in use and vice versa for a roller when a brush is in use.

Although rollers have been around for many years, and are routinely used in conjunction with brushes, there is no readily available structure where a brush can be attached to a paint tray when not in use in such a way that any drippings from the brush will be into the receptacle or tray and not over surrounding locations.

Although trays have accommodated rollers of ordinary size, there has been no tray particularly adaptable for use with trim painting. In other words, when a typical roller is used, there will be areas such as corners and edges and close proximity to abutments and other obstacles which calls for the use of brushes and smaller rollers specifically for such trim painting.

SUMMARY OF THE INVENTION

Accordingly, it is an object of the subject invention to provide a paint tray to which a roller can be firmly attached when not in use. It is a related object of the subject invention to provide attachment means for one or more brushes so that such brush or brushes can also be attached to a paint tray when not in use.

It is still one more object of the subject invention to provide means to attach both roller and brushes to a paint tray when not in use.

It is a related object of the present invention to design a tray to specifically accommodate a downsized roller useful for trim painting.

It is but one more object of the subject invention to provide attachment means for a roller and at least one brush with respect to a downsized tray specifically designed for trim painting.

It is still another object to provide a method of trim painting that includes the use of a downsized tray to be used with a downsized roller and for further providing means to attach the roller and brushes to the tray.

In accordance with the above objects, a new device has been designed which will accommodate the attachment of at least one brush and a roller to the paint tray to enable such implements to be carried along with the paint tray.

In a related embodiment, the combination of a downsized paint tray to be used in conjunction with a downsized roller is also disclosed. Additionally, as in the preferred embodiment, at least one brush can be attached to the paint tray in addition to the roller to enable brushes and roller to be carried along with the tray or otherwise held with respect to the tray when such items are not in use.

The use of holding means for such roller and brushes enables a far cleaner paint job with decreased probability of spillage or dripping from brushes or rollers when not in use.

With this new device the paint tray can be positioned in a variety of orientations over a range of approximately 90 degrees. Paint is protected from spillage in all such orientations with roller and brush attached in such a manner that all drippage from either roller or brushes occurs within the paint tray receptacle throughout the different orientations of use of the tray.

The invention includes an improved method of trim painting. Not only is it contemplated that a downsized tray will be used to specially accommodate a downsized roller as typically used for trim painting.

The method further includes providing attachment means to attach both a brush and the downsized roller to the tray when either is not in use.

DETAILED DESCRIPTION

Figure 1:
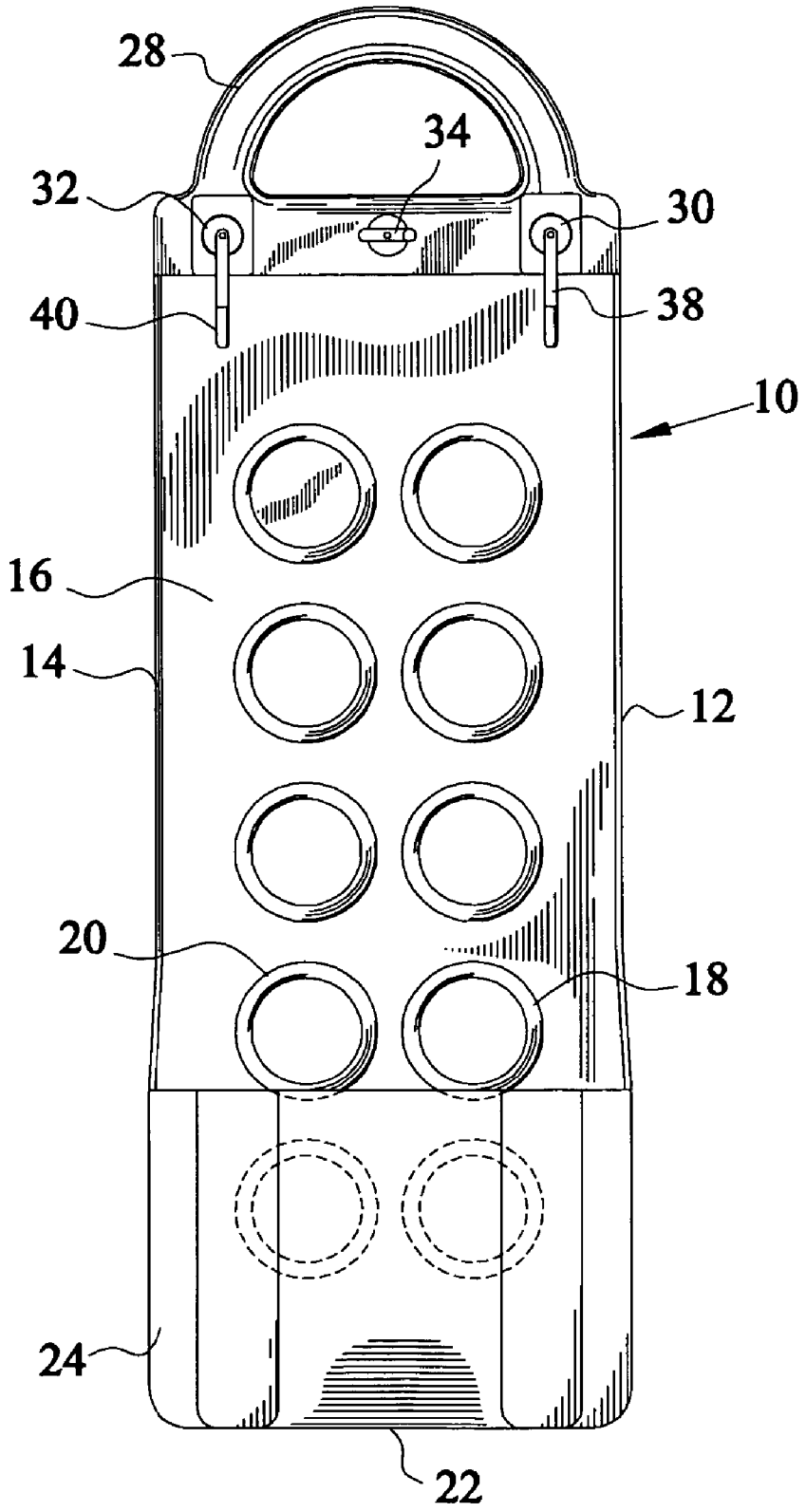
FIG. 1 is a front elevational view of the improved paint tray assuming a vertical orientation.
Figure 2:
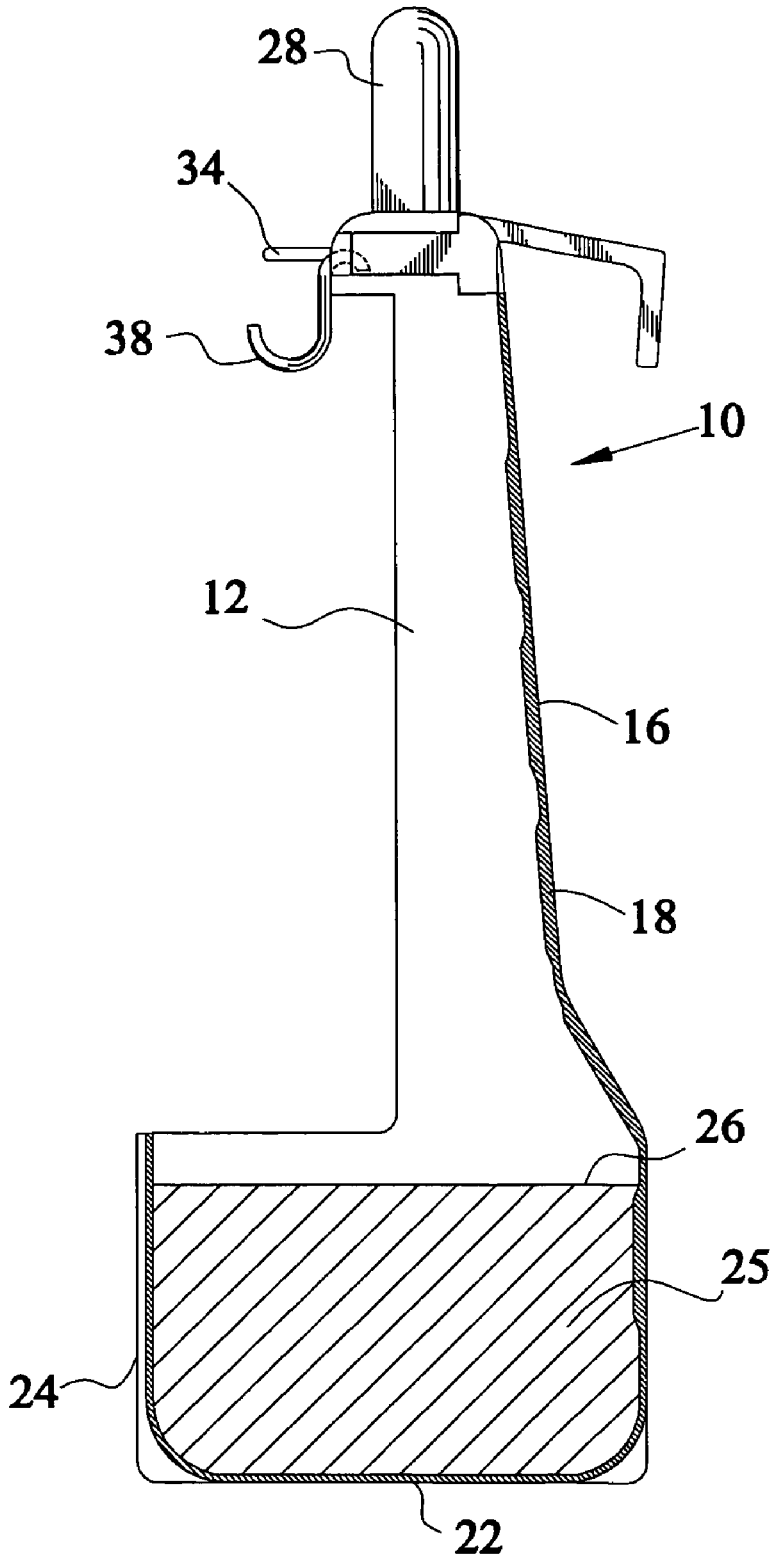
FIG. 2 is a side elevational view of FIG. 1 also in vertical orientation.

With reference to FIGS. 1 and 2, a downsized paint tray or caddy device 10 is shown having side members 12 and 14 generally extended along a ripple deck 16. The ripple deck 16 has ripples 18 and 20 which will relieve a roller (not shown)

of access paint as it is rolled over the ripples 18 and 20. This particular caddy device 10 is designed specifically for trim painting and doing touch up smaller jobs, either alone or part of a larger paint project. At present, it is cumbersome and bulky to use a full paint tray when working with trim painting and touch-up. With the smaller version, a small roller and brushes suitably adapted for trim painting can be used and conveniently carried from site to site.

When the device 10 is in upright orientation, as in FIG. 1 and FIG. 2, paint can collect within the receptacle portion formed by member 22 which intersects side members 12 and 14, and also member 16 to along with panel 24, forms enclosure 25 as seen in FIG. 2. Paint line 26 represents paint placed within the tray or caddy device 10. Of course, if the device is rotated 90 degrees (See FIG. 3), sides 16 becomes the base and the paint will run along 16 still remaining within the tray 10. A handle 28 is shown which is molded to the rest of the tray 10.

An open eye-hook 34 is positioned to receive the handle of a smaller than normal roller (not shown). Such roller can thus be secured to the paint caddy 10 by means of the open eye-hook 34 when such roller is not in use. Such securement is possible regardless of the vertical or horizontal orientation of paint caddy 10. A clamp 36 is shown to enable the attachment of the paint caddy to a ladder rung when said paint caddy 10 is to be hung. Clamp 36 is secured to device 10 by pop-in extensions 30, 32. The clamp 36 also serves as a resting protuberance when the paint caddy 10 is shown in its horizontal view. See FIG. 3

The paint tray 10 features two additional open-ended hooks 38, 40 which will accommodate and hold brushes (not shown) which routinely have an aperture near the top of their handle. For trim work, there can be smaller brushes than those used for larger jobs. Most brushes have such opening as this enables hanging the brushes on hooks in storage when not in use. The use of hooks 38, 40 enables the brushes to be hung in a location where they can have paint dripping from the brush bristles but nevertheless be in the confines of the paint tray 10 regardless of whether the tray 10 is in its vertical or horizontal orientation or somewhere in between, as for example, if it is setting on an angle as on a slanted roof.

It will be appreciated that in operation, the tray 10 may be carried by its handle 28 in a vertical orientation with the paint within as shown by paint line 26 of FIG. 2. In such manner, the tray 10 can be carried to a job, up a ladder, or generally in difficult confines with a roller (not shown) secured by eye-hook 34 and two brushes (not shown) secured by hooks 38 and 40. Of course, this enables the carrying of the tray 10 and its implements by one hand so that the other hand is free to assist in climbing a ladder or otherwise negotiating a difficult route. The clamp 36 enables the paint tray 10 to be hung in its vertical position or at a variety of slanted positions depending on the nature of where it is hung, for example, on a ladder rung or tray support atop of a step ladder. The clamp 36 also acts as a base when the paint tray is in its horizontal orientation as shown in FIG. 3.

Figure 3:
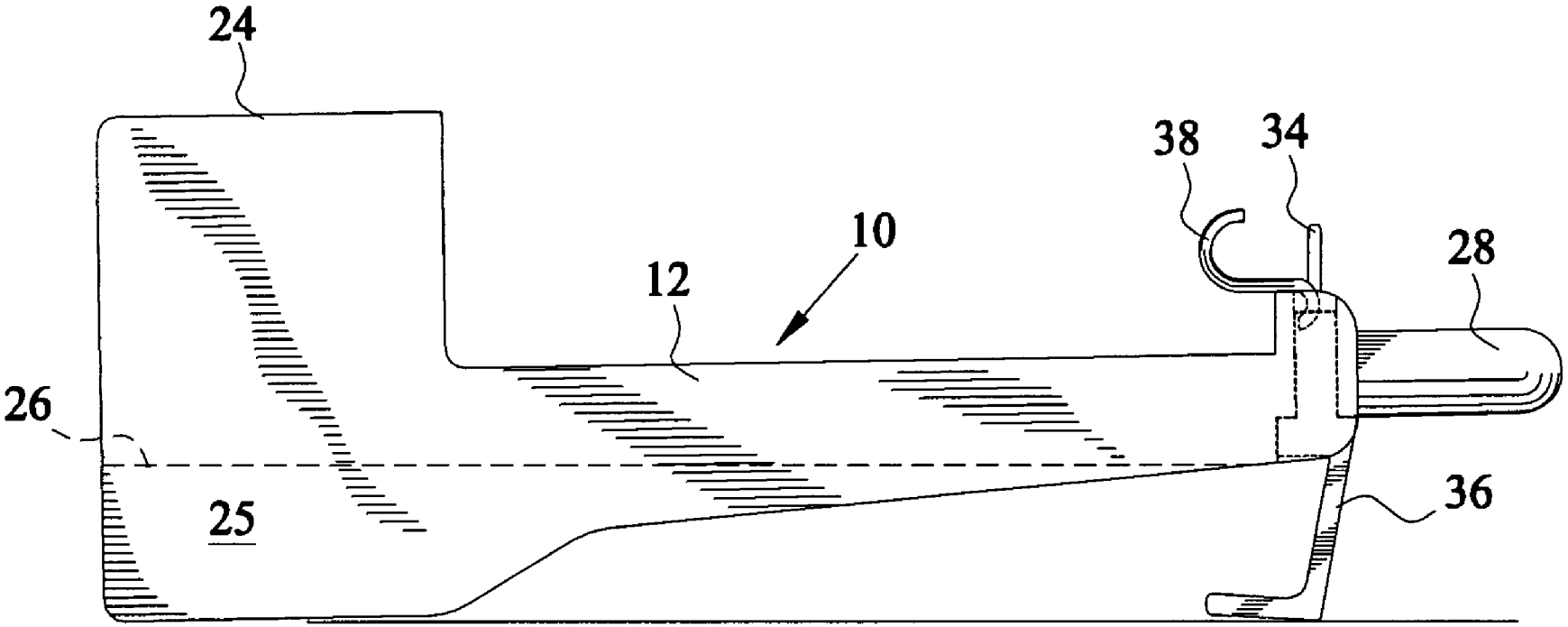
FIG. 3 is a side elevational view of the paint tray of FIG. 2 when in a horizontal position as opposed to the vertical position of FIGS. 1 and 2.

It is contemplated that a larger version substantially identical to that shown in FIGS. 1, 2 and 3 (except for size) can be used for a regular sized roller (not shown). Once again, undesirable drippage from the brushes is eliminated as all dripping will go into the paint container as the brushes and roller are secured by the hooks 38, 40 and 34. In all respects except for size the regular tray 10 is identical to the smaller sized tray 10 as shown in FIGS. 1, 2 and 3.

The above discussed equipment gives use to an improved method of trim painting. With a downsized paint tray 10, a large bulky tray or paint can no longer need be used. The downsized paint tray 10 provides all the paint necessary for trim painting and the eye hook 34 and hooks 38 and 40 provide means to hang a roller and brushes not shown, when not used.

It will be appreciated that the present invention may be adapted for utilization beyond the specific environments discussed herein. Accordingly, the present invention is not limited to the specific embodiments described herein, but is defined by the scope and spirit of the following claims.

I claim:

1. A painting device, comprising:

a vertically freestanding paint tray that can receive a brush or roller, in either one of two possible orientations, wherein said paint tray is freestanding in either a generally vertical alignment or a generally horizontal alignment;

said paint tray having an upper portion comprising a back panel, a top panel and a front panel, wherein said back panel and said front panel are in substantially parallel planes, and said back panel and said front panel are laterally separated by said top panel;

at least one holding means attached to and extending from said front panel, whereby a paint applicator can be removably hung from said at least one holding means when not in use; and a receptacle portion located at a lower portion of said paint tray, the receptacle portion having a substantially flat base and dimensioned to retain paint within said paint tray whether said paint tray is in a generally vertical alignment or a generally horizontal alignment; and wherein said paint tray is freestanding on the substantially flat base when said paint tray is in a vertical alignment, wherein said lateral separation provided by said top panel allows a brush or roller hung from said at least one holding means to hang freely without contacting said back panel when said paint tray is in a vertical alignment.

2. The painting device of claim 1 wherein the paint applicator is a roller with a handle and the hanging means secures the paint roller by said handle.

3. The painting device of claim 1 wherein the paint applicator is a brush with a handle and the hanging means secures the brush by the handle.

4. The painting device of claim 1 wherein the hanging means can hold multiple paint applicators.

5. The painting device of claim 4 wherein the multiple paint applicators are a brush and a roller and said hanging means can hold both the brush and the roller simultaneously.

6. The painting device of claim 1 further including means to attach the painting device to a ladder and the hooks are in close proximity to said attachment means.

7. The device of claim 1, further comprising a handle located at the upper portion of the painting device, wherein the handle is integrally formed with the rest of the tray.

8. The device of claim 1, further comprising a handle extending from said top panel.

9. The device of claim 1, wherein said at least one hook extends from said front panel a distance such that the removably hung brush or roller hangs freely without contacting said paint tray when said paint tray is in a vertical alignment.

10. The device of claim 1, wherein said at least one hook does not extend beyond the receptacle portion such that the removably hung brush or roller that holds excess paint will drip the excess paint into the receptacle when said paint tray is in a vertical alignment.

11. The device of claim 1, wherein said back panel functions as a base when said paint tray is in a horizontal alignment.

12. The device of claim 1, wherein at least one of said at least one holding means is a hook.

13. A method for providing support for painting, comprising the steps of:

providing a vertically freestanding paint tray that can receive a brush or roller, in either one of two possible orientations, wherein the paint tray is freestanding in either a generally vertical alignment or a generally horizontal alignment, said paint tray having an upper portion comprising a back panel, a top panel and a front panel, wherein said back panel and said front panel are in substantially parallel planes, and said back panel and said front panel are laterally separated by said top panel, and at least one holding means attached to and extending from said front panel, whereby a paint applicator can be removably hung from the at least one holding means when not in use, a receptacle portion located at a lower portion of the paint tray, the receptacle portion having a substantially flat base and dimensioned to retain paint within the paint tray whether the paint tray is in a generally vertical alignment or a generally horizontal alignment, wherein the paint tray is freestanding on the substantially flat base when the paint tray is in a vertical alignment;

whereby a painter can carry the paint tray, with at least one paint applicator hung therefrom, with one hand, wherein said lateral separation provided by said top panel allows a brush or roller hung from said at least one holding means to hang freely without contacting said back panel when said paint tray is in a vertical alignment.

14. The method of claim 13, wherein said paint tray further comprises a handle extending from said top panel.

15. The method of claim 13, wherein said at least one hook extends from said front panel a distance such that the removably hung brush or roller hangs freely without contacting said paint tray when said paint tray is in a vertical alignment.

16. The method of claim 13, wherein said at least one hook does not extend beyond the receptacle portion such that the removably hung brush or roller that holds excess paint will drip the excess paint into the receptacle when said paint tray is in a vertical alignment.

17. The method of claim 13, wherein said back panel functions as a base when said paint tray is in a horizontal alignment.

18. The method of claim 13, wherein at least one of said at least one holding means is a hook.

* * * * *